US011959706B2

(12) United States Patent
Tissot et al.

(10) Patent No.: US 11,959,706 B2
(45) Date of Patent: Apr. 16, 2024

(54) HEAT EXCHANGER PLATE WITH OPTIMIZED OPENING

(71) Applicant: Valeo Systemes Thermiques, Le Mesnil Saint Denis (FR)

(72) Inventors: Julien Tissot, Le Mesnil Saint-Denis (FR); Kamel Azzouz, Le Mesnil Saint-Denis (FR); Michael Lissner, Le Mesnil Saint-Denis (FR); Cédric De Vaulx, Le Mesnil Saint-Denis (FR); Patrick Leblay, Le Mesnil Saint-Denis (FR); Sébastien Garnier, Le Mesnil Saint-Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 507 days.

(21) Appl. No.: 17/278,908

(22) PCT Filed: Sep. 25, 2019

(86) PCT No.: PCT/FR2019/052272
§ 371 (c)(1),
(2) Date: Apr. 27, 2021

(87) PCT Pub. No.: WO2020/065227
PCT Pub. Date: Apr. 2, 2020

(65) Prior Publication Data

US 2021/0396475 A1 Dec. 23, 2021

(30) Foreign Application Priority Data

Sep. 25, 2018 (FR) ..... 1858762

(51) Int. Cl.
*F28D 9/00* (2006.01)
*F28F 3/04* (2006.01)
*F28F 3/08* (2006.01)

(52) U.S. Cl.
CPC ..... *F28D 9/005* (2013.01); *F28F 3/048* (2013.01); *F28F 3/083* (2013.01)

(58) Field of Classification Search
CPC ..... F28D 9/005; F28F 3/048; F28F 3/083
(Continued)

(56) References Cited

U.S. PATENT DOCUMENTS 2,075,236 A * 3/1937 Seligman ..... F28F 3/083 165/167
2,181,230 A * 11/1939 Groat ..... F28F 3/083 165/76

(Continued)

FOREIGN PATENT DOCUMENTS

CN 101228408 A 7/2008
CN 102498362 A 6/2012

(Continued)

OTHER PUBLICATIONS

International Search Report with Written Opinion in corresponding International Application No. PCT/FR2019/052272, dated Nov. 26, 2019 (10 pages).

(Continued)

*Primary Examiner* — Justin M Jonaitis

(57) ABSTRACT

The invention relates to a heat exchanger (20) plate (1, 2*a*) intended to delimit at least one channel (30, 30*a*, 30*b*) for circulation of a fluid, the circulation plate (1) being provided with a bottom (3) and a raised rim (5, 5*a*-5*h*) that surrounds the bottom (3), the circulation plate (1) comprising at least one opening (7, 7*a*-7*d*) through which a fluid can enter the channel (30, 30*a*, 30*b*), characterized in that the opening (7, 7*a*-7*d*) is delimited by at least one at least partially rectilinear edge (9*a*). Application to the field of heat exchanges.

14 Claims, 4 Drawing Sheets

(58) Field of Classification Search
USPC ..... 165/166
See application file for complete search history.

(56) References Cited

U.S. PATENT DOCUMENTS

| | | | | | |
|---|---|---|---|---|---|
| 2,193,405 | A * | 3/1940 | Goodman | F28F 3/083 | 165/70 |
| 2,610,834 | A * | 9/1952 | Dalzell | B30B 9/10 | 165/167 |
| 3,334,399 | A * | 8/1967 | Teeguarden | F28D 9/0056 | 29/890.039 |
| 3,532,161 | A * | 10/1970 | Loebel | F28F 9/026 | 165/140 |
| 3,631,923 | A * | 1/1972 | Izeki | F28B 9/08 | 165/DIG. 185 |
| 3,862,661 | A * | 1/1975 | Kovalenko | F28F 3/046 | 165/166 |

FOREIGN PATENT DOCUMENTS

| | | | |
|---|---|---|---|
| CN | 203464814 | U | 3/2014 |
| CN | 104303002 | A | 1/2015 |
| CN | 106246334 | A | 12/2016 |
| DE | 102016006127 | A1 | 12/2016 |
| DE | 102016201712 | A1 | 8/2017 |
| EP | 3203171 | A1 | 8/2017 |
| EP | 3301390 | A1 | 4/2018 |
| FR | 3035488 | A1 | 10/2016 |
| GB | 655075 | A | 7/1951 |
| GB | 1288887 | A | 9/1972 |
| JP | 2018054265 | A | 4/2018 |

OTHER PUBLICATIONS

Office Action Issued in corresponding CN Application No. 201980077277.5, dated Mar. 16, 2023. (10 Pages).
First Office Action in corresponding Chinese Application No. 201980077277.5, dated Jun. 21, 2022 (17 pages).

* cited by examiner

HEAT EXCHANGER PLATE WITH OPTIMIZED OPENING

The field of the present invention is that of heat exchangers, in particular heat exchangers for motor vehicles.

Motor vehicles are commonly equipped with heat exchangers. These allow heat energy to be transferred from one fluid to another fluid and are used for example to cool internal combustion engines.

Some of these heat exchangers are plate heat exchangers and they are used to cool liquids such as oil. These heat exchangers comprise a stack of plates between which a plurality of channels are formed.

The effectiveness of these heat exchangers depends on the intensity of the heat exchange between the fluids, but also on the distribution of the fluids in the channels. The plate heat exchanger also comprises a header, which distributes the fluid into each of the channels to which it is connected. This header is formed by openings provided in each of the plates.

In a known manner, this header has a circular section and the openings that form it are likewise circular in shape.

However, it has been found that this opening shape is not optimal. Specifically, a lack of uniformity in the supply of fluid to the channel has been observed. The circular shape of the opening creates regions of the channel in which the fluid flows with difficulty. Such defects create regions in which there is less heat exchange.

Therefore, the aim of the present invention is to overcome the above-described drawback by improving the distribution of the fluid over a major part of the width of the channel.

Therefore, the subject of the invention is a heat exchanger circulation plate intended to delimit at least one channel for circulation of a fluid, the circulation plate being provided with a bottom and a raised rim that surrounds the bottom, the circulation plate comprising at least one opening through which a fluid can enter the channel, characterized in that the opening is delimited by at least one at least partially rectilinear edge.

The presence of an at least partially rectilinear edge to define the opening optimizes the circulation of the fluid, forcing the latter to be distributed over a greater width of the circulation plate. This makes the circulation of the fluid more uniform over the width of the channel, thereby reducing temperature differences over the surface of the plate.

This opening shape also optimizes the circulation of the fluid by limiting the obstruction of the at least one circulation channel and by preventing the formation of dead zones over the circulation plate.

According to the invention, the two fluids circulating on either side of the plate are a refrigerant and a heat-transfer liquid. The circulation plate is thus configured to delimit a first channel through which the refrigerant passes and a second channel through which the heat-transfer liquid passes.

According to one feature of the invention, the rectilinear part of the edge forms part of the bottom.

According to another feature of the invention, the at least partially rectilinear edge forms a first edge, the opening being delimited by a second edge that forms part of the raised rim. In such a case, the opening is delimited by a first at least partially rectilinear edge that is provided in the bottom, and by the second edge that forms part of the raised rim. The position of the second edge on the raised rim makes it possible to limit the dead zones that are usually found between the opening and the raised rim. The dead zones are characterized by low heat exchange, and so they reduce the performance of plate heat exchangers.

According to an alternative, the at least partially rectilinear edge forms a first edge, the opening being delimited by a second edge that forms part of the bottom. In such a case, the second edge can follow a profile that is homothetic with a curved part of the raised rim. The first edge and the second edge that delimit the opening may both form part of the bottom.

In accordance with the invention, the fluid moves along the circulation plate in a direction of flow, the rectilinear part of the edge extending along a straight line transverse to the direction of flow.

Advantageously, the bottom comprises a rib arranged such that the channel has a U-shaped profile.

Also advantageously, at least the opening is at least partially surrounded by a shoulder which protrudes from the bottom and at least one top side of which extends in a plane substantially parallel, advantageously parallel, to a plane in which the bottom extends. The top side is configured to come to bear against a bottom of an adjacent plate.

The shoulder at least partially surrounds the opening that has the at least partially rectilinear edge. In such a case, the at least partially rectilinear edge is formed on the top side of the shoulder.

According to one feature of the invention, the shoulder comprises a flank that at least partially surrounds the opening and is interposed between the bottom and the top side.

According to another feature of the invention, the circulation plate has a rectangular shape and comprises a first longitudinal end and a second longitudinal end, a first opening that does not have a shoulder being provided at the first longitudinal end of the circulation plate, while a second opening having a shoulder is provided at the second longitudinal end of the circulation plate.

Likewise, the bottom comprises at least one disruptor for the flow of the fluid. The bottom may comprise a plurality of disruptors that protrude from the bottom and extend in the channel. The flow disruptors make it possible to create a turbulent flow along the circulation plate. They disrupt the boundary layer of the refrigerant and/or of the heat-transfer liquid that circulates in the channel(s).

Advantageously, at least one opening has an elongate shape.

According to one embodiment of the invention, at least one opening may have a triangular or rectangular shape.

The shape of the opening that is intended here is observed at a viewing angle with a direction perpendicular to a plane in which the bottom extends.

These opening shapes allow the fluids to be distributed over a larger part of the width of the circulation plate and thus make it possible to maximize the surface areas for heat exchange. They also make it possible to reduce the space between the two openings, which usually exhibits low thermal activity.

Advantageously, the heat exchanger comprises at least one circulation plate according to any one of the preceding features. In such a case, the plate is a closure plate of the heat exchanger or a circulation plate of this heat exchanger.

According to another feature of the invention, the heat exchanger comprises two circulation plates that are nested one inside the other and delimit between one another the channel that is able to be taken by a refrigerant or a heat-transfer liquid.

According to yet another feature of the invention, three circulation plates are nested one inside another and delimit in pairs a first channel and a second channel, the first channel being configured to be taken by a refrigerant while the second channel is configured to be taken by a heat-transfer liquid.

Further features, details and advantages of the invention will become more clearly apparent from reading the description given below by way of indication and with reference to the drawings, in which.

It should first of all be noted that the figures set out the invention in detail for implementing the invention, it being, of course, possible for said figures to serve to better define the invention if necessary.

In the rest of the description, the designations longitudinal or lateral, top, bottom, front, rear refer to the orientation of the plates according to the invention. A longitudinal direction A corresponds to the main axis of the plates along which they mostly extend, while the lateral orientations correspond to concurrent straight lines, that is to say straight lines which cross the longitudinal direction, notably perpendicular to the longitudinal axis of the plates. This is for example the lateral direction B or the stacking direction d. The longitudinal direction A is parallel to a longitudinal axis l of a trihedron l, v, t, while the lateral direction B is parallel to a transverse axis t of the trihedron, the stacking direction being parallel to a vertical axis v of the trihedron.

Figure 1:
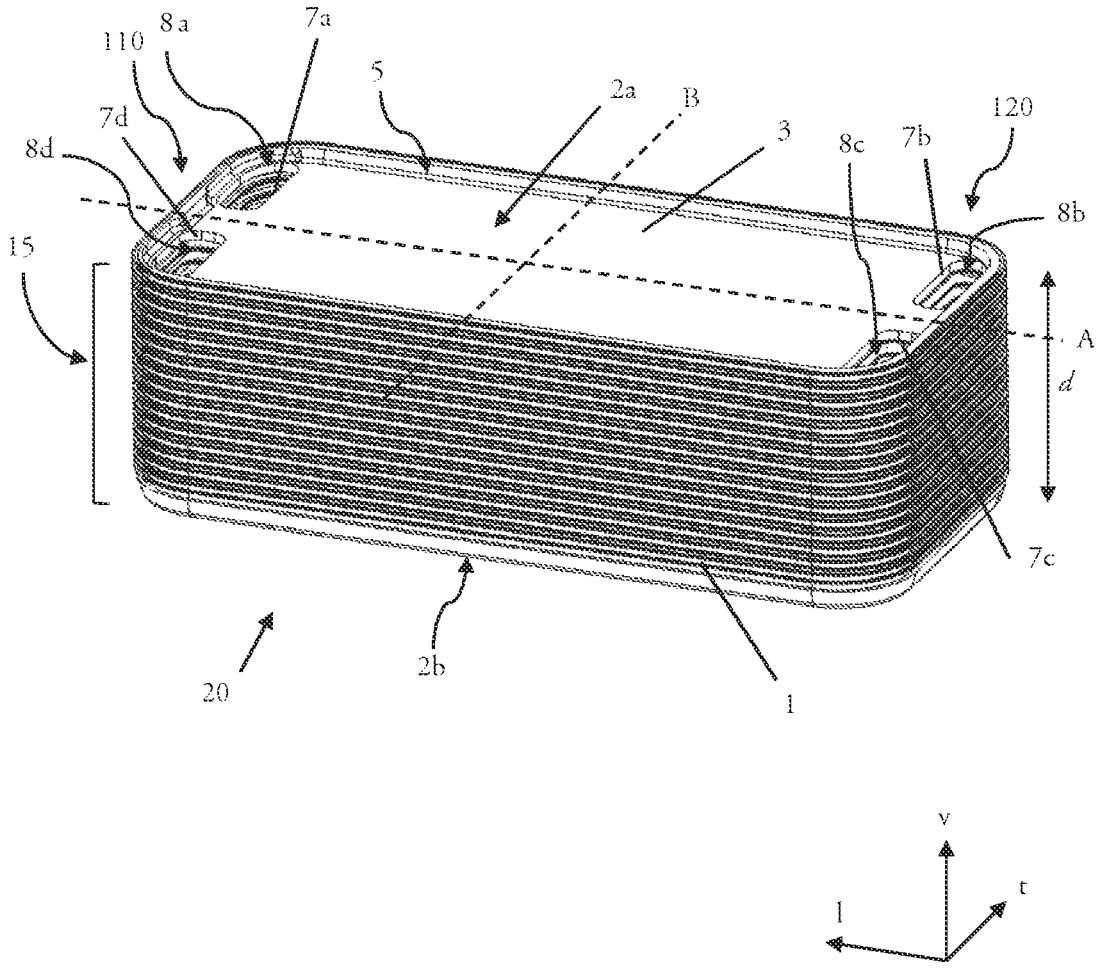
FIG. 1 is a perspective view of a heat exchanger according to the invention.

FIG. 1 shows a perspective view of a heat exchanger 20 according to the invention.

The heat exchanger 20 implements an exchange of heat energy between a first fluid and a second fluid. The first fluid is for example a refrigerant and the second fluid is for example a heat-transfer liquid.

The heat exchanger according to the invention is configured such that the refrigerant and the heat-transfer liquid exchange heat energy without coming into contact. This feature will be described in more detail later on in the detailed description.

The heat exchanger 20 comprises a heating body 15 where the exchange of heat between the refrigerant and the heat-transfer liquid takes place. The heating body 15 is formed by a superposition of plates in a stacking direction d. The plates according to the invention are the circulation plates 1 and at least one closure plate 2*a*, which is intended to close the upper part of the heating body 15 in a sealed manner in the stacking direction d. This closure plate 2*a* is positioned on top of the set of circulation plates 1 of the heating body 15, in the stacking direction d.

The closure plate 2*a* and the circulation plate 1 are subsumed under the term plate in the present document, and the feature(s) described in relation to this term apply identically to the closure plate 2*a* and to the circulation plate 1.

The heat exchanger 20 also comprises a closure endplate 2*b* intended to close the lower part of the heating body 15 in a sealed manner in the stacking direction d. This closure endplate 2*b* is positioned underneath the set of circulation plates 1 of the heating body 15, that is to say on the opposite side from the closure plate in the stacking direction d with respect to the circulation plates 1.

The circulation plates 1, the closure plate 2*a* and the closure endplate 2*b* exhibit a configuration in the form of a trough. A rim of the plate according to the invention, that is to say at least the circulation plate 1 or the closure plate 2*a* or the closure endplate 2*b*, is a raised rim 5 that surrounds a bottom 3, thereby forming a bottom of the trough. The bottom 3 of the plate has a rectangular shape with rounded rims. The raised rim 5 of the plate according to the invention, which surrounds the bottom 3, extends continuously all around the bottom 3 and has longitudinal and lateral rectilinear parts that are joined by curved parts provided at each corner of the plate according to the invention.

The closure plate 2*a* and at least one circulation plate 1 comprise at least one opening 7. According to the example in FIG. 1, the closure plate 2*a* and the circulation plate comprise four openings referenced 7*a*, 7*b*, 7*c* and 7*d*. The first opening 7*a* and the fourth opening 7*d* are positioned at a first longitudinal end 110 of the plate. The second opening 7*b* and the third opening 7*c* are positioned at a second longitudinal end 120 of the plate according to the invention.

The first opening 7*a*, the second opening 7*b*, the third opening 7*c* and the fourth opening 7*d* each have an elongate shape in this FIG. 1. The term elongate is understood as meaning a shape that is longer than it is wide. This elongate shape can be seen in a plane AB of the plate in question.

Thus, the first opening 7*a* has a side that extends in the longitudinal direction A of the circulation plate 1 or closure plate 2*a* and follows a part of the raised rim 5 provided at the first longitudinal end 110 of the plate. This feature also applies to the second opening 7*b*, third opening 7*c* and fourth opening 7*d*.

The closure endplate 2*b* positioned under the stack of circulation plates 1 in the direction d does not have any openings, so that the heat-transfer liquid and the refrigerant do not escape from the heating body 15.

The heat exchanger 20 extends in the longitudinal direction A and, for its part, also comprises a first longitudinal end 110 and a second longitudinal end 120, the first longitudinal end 110 being on the opposite side from the second longitudinal end 120.

The heat exchanger 20 has four headers 8, a first header 8*a*, a second header 8*b*, a third header 8*c* and a fourth header 8*d*. The first header 8*a* and the fourth header 8*d* are each positioned in a corner of the first longitudinal end 110 of the heat exchanger 20. The second header 8*b* and the third header 8*c* are each positioned in a corner of the second longitudinal end 1 of the heat exchanger 20.

The first header 8*a*, the second header 8*b*, the third header 8*c* and the fourth header 8*d* are volumes that extend in the stacking direction d of the heating body 15. The function of these headers is to distribute or collect the heat-transfer liquid or the refrigerant in the first channels 30*a* and in the second channels 30*b* (visible in FIG. 2). A header 8 volume is delimited on one side by the opening 7 in the closure plate 2*a*, by the closure endplate 2*b* and by each of the openings 7 in the circulation plates 1, as will be described in more detail below.

The heat-transfer liquid and the refrigerant circulate separately in the heat exchanger 20. The first header 8*a* and the fourth header 8*d* are the headers 8 reserved for distributing or collecting the heat-transfer liquid in the heating body 15. For their part, the second header 8*b* and the third header 8*c* are the headers intended to distribute or collect the refrigerant in the heating body 15.

The first header 8*a* is the inlet for the heat-transfer liquid into the heating body 15 and the fourth header 8*d* is the outlet for the heat-transfer liquid from the heating body 15. In an equivalent manner, the second header 8*b* is the inlet for the refrigerant into the heating body 15 and the third header 8*c* is the outlet for the refrigerant from the heating body 15.

Figure 2:
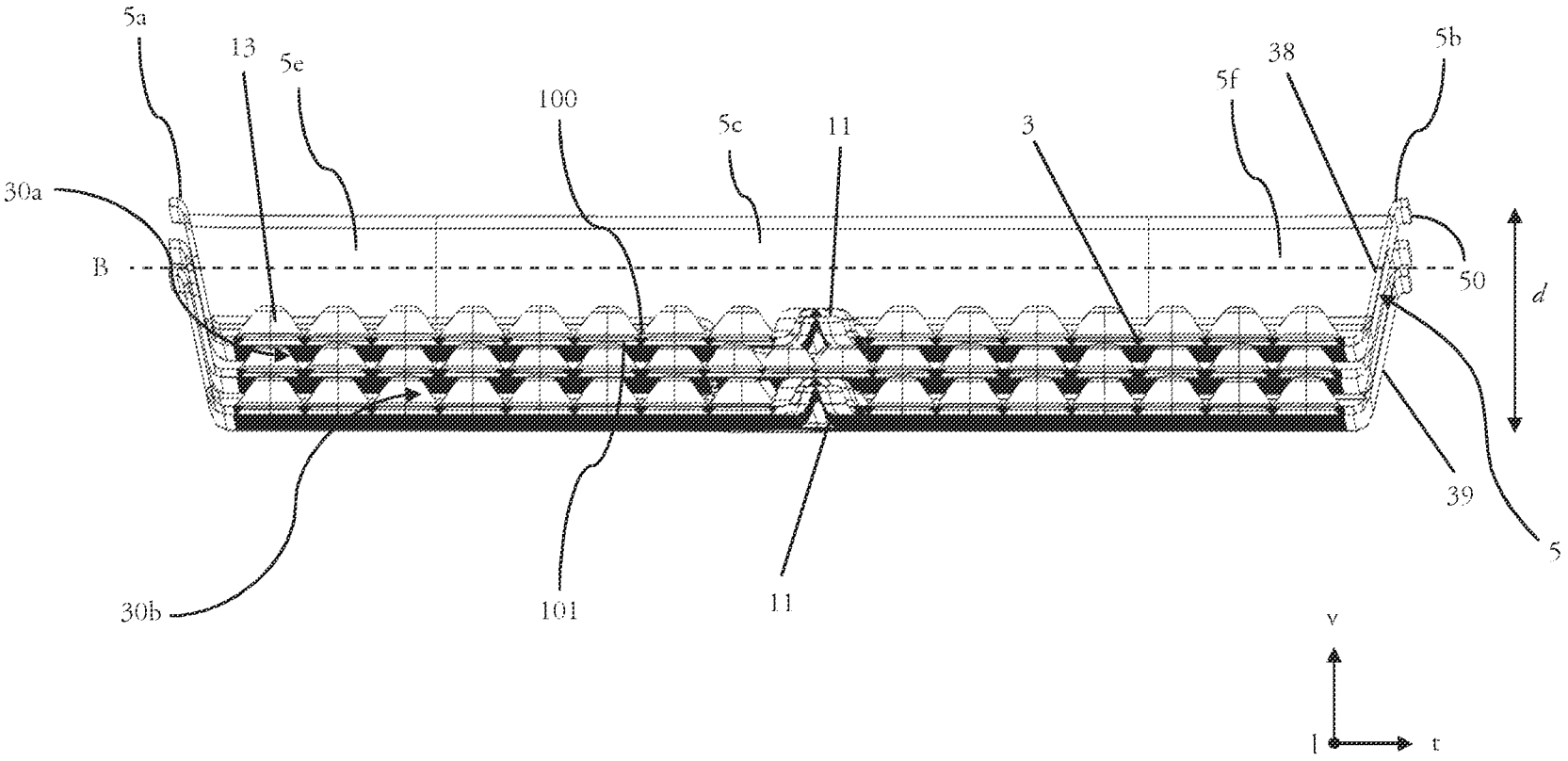
FIG. 2 is a view in cross section of a stack of three constituent circulation plates of the heating body of a heat exchanger according to the invention.

FIG. 2 presents a lateral cross-sectional view of a stack of circulation plates 1 according to the invention, on a plane B, d in FIG. 1.

The superposition of the circulation plates 1 delimits channels 30 which are separate from one another. A first channel 30*a* is designed for the refrigerant to pass through and a second channel 30*b* is designed for the heat-transfer liquid to pass through. The heating body is organized so as to have an alternation of first channel 30*a* and second channel 30*b* in the stacking direction. The refrigerant and the heat-transfer liquid therefore flow in the heating body alternately between the first channel 30*a* and the second channel 30*b*.

FIG. 2 illustrates the presence of disruptors 13 for the flow of the fluid that are provided on the bottom 3 of the circulation plate 1. The disruptors 13 extend above a plane of overall extension of the bottom 3 of the circulation plate 1, protruding above the bottom 3 in the channel.

The function of the disruptors 13 is to disrupt the boundary layer of the heat-transfer liquid and/or of the refrigerant in the first channel 30*a* and in the second channel 30*b*, respectively. Thus, the disruptors 13 maximize heat exchanges between the refrigerant and the heat-transfer liquid.

The circulation plate 1 in FIG. 2 comprises the raised rim 5, the latter being divided into a first longitudinal raised rim 5*a*, a second longitudinal raised rim 5*b*, a first lateral raised rim 5*c* and a second lateral raised rim, which is not visible in this figure. These longitudinal and lateral raised rims are joined by curved raised rims 5*e*, 5*f*, 5*g* and 5*h*, as is apparent in FIGS. 1 and 3 to 5.

The raised rim 5 comprises an upper face 38 and a lower face 39. A part of the lower face 39 of the raised rim 5 of a first circulation plate 1 comes into contact with a part of the upper face 38 of the raised rim 5 of a second circulation plate 1. This contact between walls, which is realized around the entire perimeter of the raised rim 5, creates a seal between two circulation plates 1, so as to form the first channel 30*a* or the second channel 30*b*. This feature applies to all of the raised rims of the circulation plates 1, of the closure plate 2*a* and of the closure endplate 2*b* of the heat exchanger 20 of the invention.

As illustrated in FIG. 2, the raised rim 5 of the circulation plate 1 ends with a peripheral flange 50. This peripheral flange 50 extends in a plane parallel to the plane of the bottom 3 of the circulation plate 1 and extends all around the circulation plate 1. It will be noted that the peripheral flange 50 of a first circulation plate 1 is at a distance from the peripheral flange 50 of the second circulation plate 1, which is nested in the first circulation plate 1. This feature applies to all of the raised rims of the circulation plates 1 of the heat exchanger 20.

The circulation plate 1 has a bottom 3 having an upper face 100 and a lower face 101. The stack of the circulation plates 1 in the stacking direction d is characterized by the fact that the lower face 101 of the bottom 3 of a first circulation plate 1 faces and is at a nonzero distance from the upper face 100 of the bottom 3 of a second circulation plate 1 that is immediately adjacent to the first circulation plate 1. In this way, the first channel 30*a* and the second channel 30*b* are created.

Figure 3:
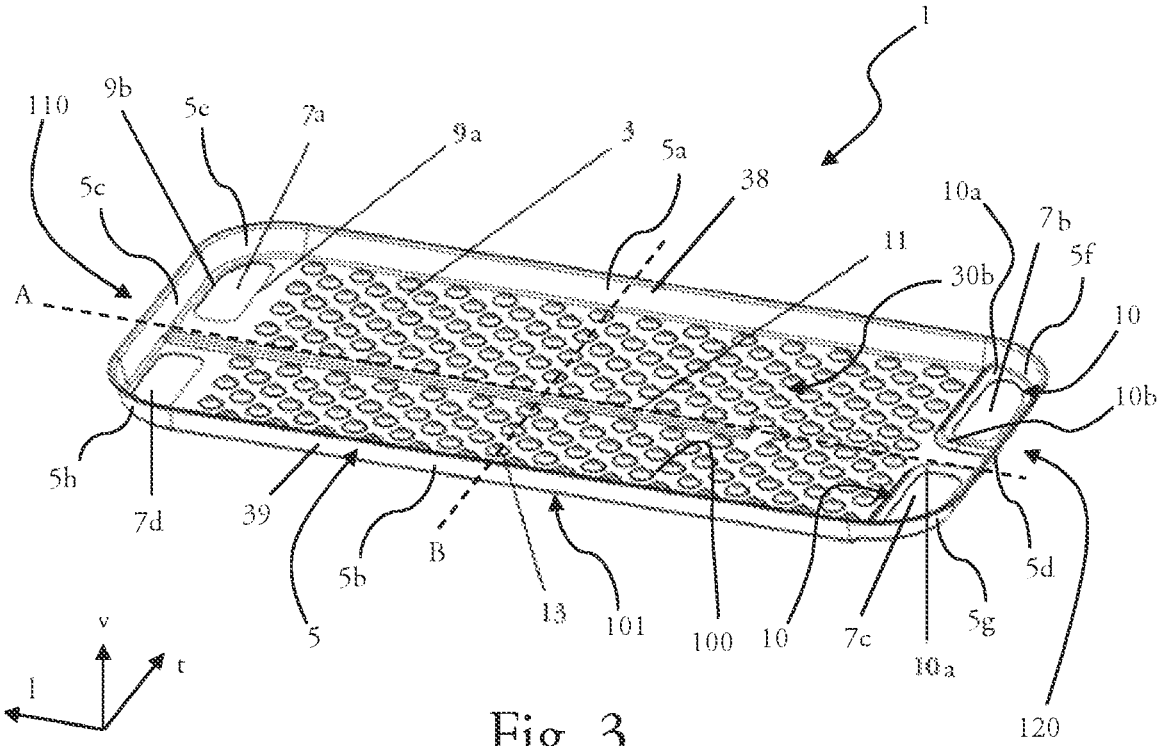
FIG. 3 is a perspective view of a circulation plate of a heat exchanger according to a first embodiment of the invention.
Figure 4:
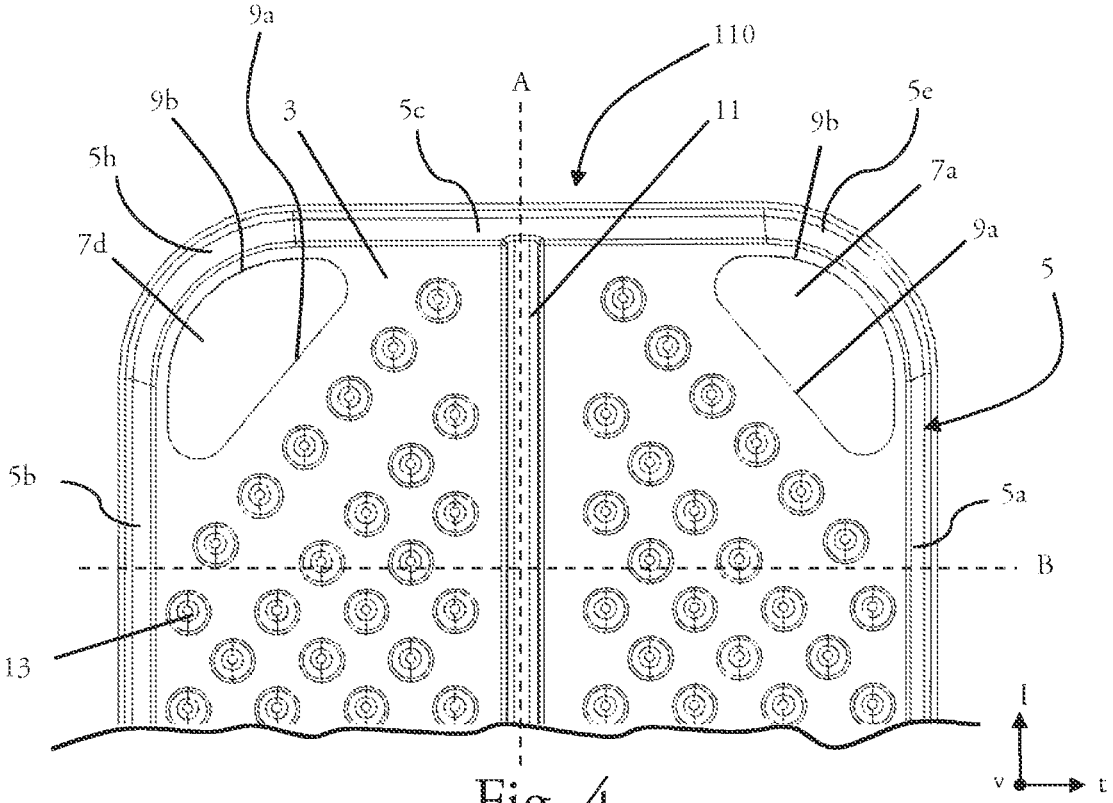
FIG. 4 is a close-up view of a circulation plate of a heat exchanger according to a second embodiment of the invention.
Figure 5:
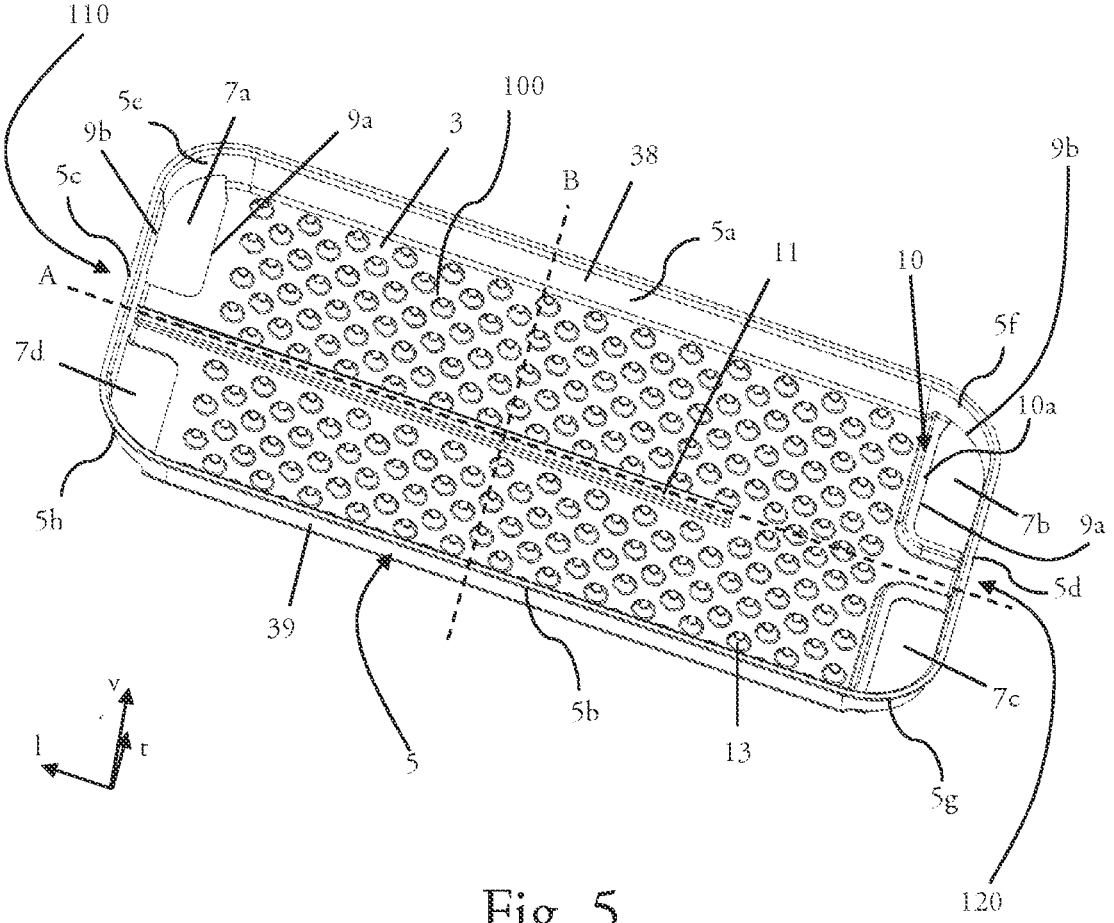
FIG. 5 is a perspective view of a circulation plate of a heat exchanger according to a third embodiment of the invention.

FIGS. 3, 4 and 5 illustrate three embodiments of the circulation plates 1 according to the invention. FIG. 3 illustrates a circulation plate 1 according to a first embodiment of the invention.

The circulation plate 1 is in the form of a trough, meaning that it comprises the bottom 3, surrounded continuously around its periphery by the first longitudinal raised rim 5*a*, the second longitudinal raised rim 5*b*, the first lateral raised rim 5*c*, the second lateral raised rim 5*d*, a first curved raised rim 5*e*, a second curved raised rim 5*f*, a third curved raised rim 5*g* and a fourth curved raised rim 5*h*.

The curved raised rims are disposed at the corners of the plate according to the invention and join a longitudinal raised rim to a lateral raised rim.

The circulation plate 1 extends in the longitudinal direction A between the first longitudinal end 110 and a second longitudinal end 120, the first longitudinal end 110 being at the opposite end from the second longitudinal end 120 with respect to the bottom 3.

Each circulation plate 1 comprises at least one opening 7. In the example in FIG. 3, the circulation plate 1 comprises four openings 7, a first opening 7*a*, a second opening 7*b*, a third opening 7*c* and a fourth opening 7*d*. The first opening 7*a* and the fourth opening 7*d* are positioned at the first longitudinal end 110 of the circulation plate 1. The second opening 7*b* and the third opening 7*c* are positioned at the second longitudinal end 120 of the circulation plate 1.

In the exemplary embodiment in FIG. 3, the first opening 7*a*, the second opening 7*b*, the third opening 7*c* and the fourth opening 7*d* in the circulation plate 1 have an elongate shape, as seen in the plane AB. The opening 7 is therefore longer than it is wide, and this elongation is realized in the transverse direction B.

The first opening 7*a*, the second opening 7*b*, the third opening 7*c* or the fourth opening 7*d* in the circulation plate 1 have the rectilinear first edge 9*a* that is parallel to the lateral raised rim 5*c*, 5*d*. The opening in question is also delimited by the second edge 9*b*, which follows the lateral raised rim 5*c*, 5*d* and the curved raised rim 5*e*, 5*f*, 5*g*, 5*h*.

The rectilinear first edge 9*a* and the second edge 9*b* form an edge face of the bottom 3 of the circulation plate 1. The second edge 9*b* that delimits the opening 7 illustrated in this FIG. 3 has a first portion, which is parallel to the lateral raised rim 5*c*, 5*d*, and a second portion, which follows the curvature of the curved raised rim 5*e*, 5*f*, 5*g*, 5*h*.

According to FIG. 3, two openings situated at one and the same longitudinal end of the circulation plate 1, for example the second opening 7*b* and the third opening 7*c*, are each surrounded by a shoulder 10. The shoulder 10 is a hump which protrudes from the bottom 3 of the circulation plate 1. The shoulder 10 is made up of a top side 10*a* and of a second shoulder part 10*b*. The top side 10*a* extends above the plane AB of the bottom 3 of the circulation plate 1, and parallel thereto, while the second shoulder part 10*b* joins the bottom 3 to the top side 10*a*.

It will be noted that only the second opening 7*b* and the third opening 7*c* at the second longitudinal end 120 are provided with a shoulder, the first opening 7*a* and the fourth opening 7*d* at the first longitudinal end 110 not having a shoulder. The first opening 7*a* and the fourth opening 7*d* are thus made directly in the bottom 3.

In order that the refrigerant and the heat-transfer liquid circulate alternately in the first channel and in the second channel, it will be understood that, in the stack of circulation plates 1, one circulation plate 1 will comprise at least one shoulder positioned on at least one opening 7 at a first longitudinal end 110 and the adjacent circulation plate 1 in the stack will comprise at least one shoulder on at least one opening 7 at a second longitudinal end 120. Put another way, the heating body comprises a plurality of circulation plates 1 in which at least one shoulder is formed alternately at one longitudinal end of the heating body or at the other longitudinal end of the heating body.

All of the features of the openings 7 in the circulation plate 1 that are described in FIG. 3 apply to the plurality of circulation plates 1 of the heat exchanger.

According to one feature of the invention, each pair of openings 7 positioned at the first longitudinal end 110 and at the second longitudinal end 120 of the circulation plate 1 correspond separately to an inlet and to an outlet for the refrigerant or for the heat-transfer liquid. According to one nonlimiting example, the first opening 7*a* corresponds to an inlet for the heat-transfer liquid and the fourth opening 7*d* corresponds to the outlet for the heat-transfer liquid. The second opening 7*b* corresponds to the inlet for the refrigerant, while the third opening 7*c* corresponds to the outlet for the refrigerant.

The circulation plate 1 also comprises a rib 11, which protrudes from the bottom 3 of the circulation plate 1 and extends in the longitudinal direction A. This rib 11 starts at the first lateral raised rim 5*c*, between the first opening 7*a* and the fourth opening 7*d*, and extends in the direction of the second longitudinal end 120 of the circulation plate 1. The rib 11 ends at a nonzero distance from the second lateral raised rim 5*d* and thus divides the volume delimited by two circulation plates 1 to form the U-shaped channel.

This feature will be understood as meaning that the circulation of the fluids along the circulation plates 1 takes place with a U-shaped circulation, meaning that the heat-transfer liquid or the refrigerant will enter the channel in question through an opening 7 disposed at one longitudinal end of the circulation plate 1, will follow the rib 11 and then pass around it, in order to exit through another opening 7 disposed at the same longitudinal end of the circulation plate 1.

In FIG. 3, it can be seen that the bottom 3 of the circulation plate 1 is provided with disruptors 13 for the flow of fluid. These are disposed in mutually parallel rows that are aligned parallel to the transverse direction B. At least one of these rows of disruptors 13 is parallel to the rectilinear edge 9*a*. These rows are offset in the transverse direction B, such that the disruptors 13 are disposed in a staggered manner from one row to the next, thereby forming tiers of disruptors 13 parallel to the longitudinal direction A.

FIG. 4 illustrates a second embodiment of the circulation plate 1 according to the invention. For the elements of the circulation plate 1 that are common to the previous embodiment, reference will be made to FIG. 3 and to the detailed description thereof.

FIG. 4 presents the first longitudinal end 110 of the circulation plate 1. The first opening 7*a* and the fourth opening 7*d* are delimited by a rectilinear first edge 9*a* and by a curved second edge 9*b*, which follows the curvature of the curved raised rim 5*e*, 5*h* of the circulation plate 1. The opening in question is thus delimited entirely by the rectilinear first edge 9*a* and by the curved second edge 9*b*.

According to the example in FIG. 4, the rectilinear first edge 9*a* extends in a direction which is transverse to the longitudinal direction A and to the transverse direction B. The direction in which the rectilinear part of the first edge 9 extends forms an angle with the longitudinal direction A of the circulation plate 1 of between 30 and 60°, advantageously 45°. It will be noted that the direction in which the rectilinear part of the first edge 9 extends intersects the lateral raised rim 5*c*, between the rib 11 and the curved raised rim 5*e*, and also intersects the longitudinal raised rim 5*a*, between two curved raised rims that are situated on either side of the longitudinal raised rim 5*a*.

Although not shown, a shoulder can be formed around these openings 7 of triangular shape.

The opening 7 delimited by this rectilinear first edge 9*a* and by this curved second edge 9*b* is provided in the bottom 3. The rectilinear first edge 9*a* and the curved second edge 9*b* are therefore edge faces of the bottom 3 of the circulation plate 1.

The opening(s) 7 illustrated in this FIG. 4 has/have a triangular shape, as seen in a plane AB, with rounded corners.

The circulation plate 1 according to the variant illustrated in FIG. 4 has disruptors 13 on its bottom 3. In contrast to FIG. 3, the triangular nature of the openings 7 allows disruptors 13 to be disposed in the vicinity of the first longitudinal end 110 of the circulation plate 1. Thus, the circulation plate 1 comprises disruptors 13 that are provided between the rib 11 and the opening 7. A line of disruptors 13 is parallel to the rectilinear part of the first edge 9*a*.

FIG. 5 presents a third embodiment of the invention. For the elements of the circulation plate 1 that are common to the previous embodiments, reference will be made to the detailed description of FIG. 3 or 4.

Four openings 7 can be seen therein, made up of the first opening 7*a*, the second opening 7*b*, the third opening 7*c* and the fourth opening 7*d*. The first opening 7*a* and the fourth opening 7*d* have a rectilinear first edge 9*a* formed by the bottom 3 of the circulation plate 1. The rectilinear first edge 9*a* is an edge face of the bottom 3 of the circulation plate 1 and the rectilinear part is parallel to the first lateral raised rim 5*c*. The second opening 7*b* and the third opening 7*c*, for their part, also have a rectilinear first edge 9*a* formed by the shoulder 10 that protrudes from the bottom 3 of the circulation plate 1, as described in detail in FIG. 3. The rectilinear first edge 9*a* that delimits this second opening 7*b* or this third opening 7*c* is an edge face of this shoulder 10 and the rectilinear part is parallel to the second lateral raised rim 5*d*.

The opening(s) 7 illustrated in this FIG. 5 also has/have a second edge 9*b*, a first portion of which is parallel to the lateral raised rim 5*c*, 5*d*, and a second portion of which follows the curvature of the curved raised rim 5*e*, 5*f*, 5*g*, 5*h*.

The second edge 9*b*, in particular its first portion and its second portion, is part of the raised rim 5. More specifically, the first portion of the second edge 9*b* is an edge face of the lateral raised rim 5*c* and the second portion of the second edge 9*b* is an edge face of the curved raised rim 5*e*, which adjoins the lateral raised rim 5*c*.

It will be understood from the above that the opening(s) 7 in the third embodiment, as illustrated in FIG. 5, extend(s) in the plane of the bottom 3 and also in a plane that follows the profile of the raised rim 5. As such, the opening 7 in question has an L-shaped section, as seen in a plane parallel to the longitudinal direction A and perpendicular to the bottom 3.

The above description of the opening 7 applies, of course, to the openings 7*c*, 7*d* that are surrounded by the shoulder 10, such as those provided at the second longitudinal end 120. In such a case, the first edge 9*a* and the rectilinear part thereof belong to the shoulder 10, while the second edge 9*b* is part of the raised rim 5.

Although these openings 7 are delimited by the raised rim 5, the latter nevertheless maintains a sufficient height for leaktight contact to be made between the raised rim of a first circulation plate and the raised rim of a second circulation plate.

The invention thus achieves its stated objective by improving the distribution of the fluid over the width of the channel, thereby improving the uniformity of temperatures over this width.

The invention is not intended to be limited to the means and configurations exclusively described and illustrated, however, but also applies to all equivalent means or configurations and to any combination of such means or configurations. In particular, while the invention has been described here in its application to a heat exchanger involving refrigerant and heat-transfer liquid, it goes without saying that it applies to any shape and/or size of plate or to any type of fluid circulating along the plate according to the invention.

The invention claimed is:

1. A heat exchanger plate configured to delimit at least one channel for circulation of a fluid, the heat exchanger plate comprising:

a bottom and a raised rim that surrounds the bottom; and at least one opening through which the fluid enters the at least one channel, wherein the at least one opening is delimited by an at least partially rectilinear edge, wherein the at least partially rectilinear edge forms a first edge that extends in a direction that forms an angle of between 30 and 60 degrees with respect to a longitudinal direction of the heat exchanger plate, and wherein the bottom comprises a rib arranged such that the channel has a U-shaped profile.

2. The plate as claimed in claim 1, wherein the rectilinear part of the edge forms part of the bottom.

3. The plate as claimed in claim 2, wherein the opening is delimited by a second edge that forms part of the raised rim.

4. The plate as claimed in claim 2, wherein the opening is delimited by a second edge that forms part of the bottom.

5. The plate as claimed in claim 4, wherein:

the raised rim includes:

a first lateral raised rim that extends in a direction perpendicular to the longitudinal direction of the heat exchanger plate;

a first longitudinal raised rim that extends in a direction parallel to the longitudinal direction of the heat exchanger plate; and a curved raised rim that joins the first lateral raised rim and the first longitudinal raised rim;

wherein the at least one opening comprises a first opening disposed between the rib and the first longitudinal raised rim, the first opening comprising the first edge; and the direction, in which the first edge extends, intersects the first lateral raised rim between the rib and the curved raised rim.

6. The plate as claimed in claim 1, wherein the opening is delimited by a second edge that forms part of the bottom.

7. The plate as claimed in claim 1, wherein at least the opening is at least partially surrounded by a shoulder which protrudes from the bottom and at least one top side of which extends in a plane substantially parallel to a plane in which the bottom extends.

8. The heat exchanger plate as claimed in claim 7, wherein the rectilinear part of the edge is formed on the top side of the shoulder.

9. The plate as claimed in claim 1, wherein the plate has a rectangular shape and comprises a first longitudinal end and a second longitudinal end, a first opening that does not have a shoulder being provided at the first longitudinal end of the circulation plate, while a second opening having a shoulder is provided at the second longitudinal end of the plate.

10. The plate as claimed in claim 1, wherein the bottom comprises at least one disruptor for the flow of the fluid.

11. A heat exchanger comprising:

at least one plate that is a closure plate of the heat exchanger or a circulation plate of the heat exchanger, the plate comprising:

a bottom and a raised rim that surrounds the bottom, and at least one opening through which a fluid enters the at least one channel, wherein the at least one opening is delimited by at least one partially rectilinear edge, wherein the at least partially rectilinear edge forms a first edge that extends in a direction that forms an angle of between 30 and 60 degrees with respect to a longitudinal direction of the heat exchanger plate, and wherein the bottom comprises a rib arranged such that the channel has a U-shaped profile.

12. The heat exchanger as claimed in claim 11, wherein the rectilinear part of the edge forms part of the bottom.

13. The heat exchanger as claimed in claim 12, wherein the opening is delimited by a second edge that forms part of the bottom.

14. The heat exchanger as claimed in claim 13, wherein:

the raised rim includes:

a first lateral raised rim that extends in a direction perpendicular to the longitudinal direction of the heat exchanger plate;

a first longitudinal raised rim that extends in a direction parallel to the longitudinal direction of the heat exchanger plate; and a curved raised rim that joins the first lateral raised rim and the first longitudinal raised rim;

wherein the at least one opening comprises a first opening disposed between the rib and the first longitudinal raised rim, the first opening comprising the first edge; and the direction, in which the first edge extends, intersects the first lateral raised rim between the rib and the curved raised rim.

* * * * *